United States Patent [19]

Kimura et al.

[11] Patent Number: 4,614,542

[45] Date of Patent: Sep. 30, 1986

[54] METHOD OF OPERATING A COPPER CONVERTER

[75] Inventors: Takayoshi Kimura; Seiichi Tsuyuguchi, both of Niihama, Japan

[73] Assignee: Sumitomo Metal Mining Company Limited, Tokyo, Japan

[21] Appl. No.: 768,561

[22] Filed: Aug. 23, 1985

[30] Foreign Application Priority Data

Aug. 31, 1984 [JP] Japan ..... 59-182211

[51] Int. Cl.[4] ..... C22B 15/00

[52] U.S. Cl. ..... 75/76

[58] Field of Search ..... 75/76

[56] References Cited

U.S. PATENT DOCUMENTS 4,073,646 2/1978 Kryczum ..... 75/76

*Primary Examiner*—Peter D. Rosenberg

*Attorney, Agent, or Firm*—Watson, Cole, Grindle & Watson

[57] ABSTRACT

An improved method of operating a converter for producing copper includes introducing at least a part of a flux and a cold charge in powdery form into a molten charge in the converter through at least one lance.

8 Claims, 4 Drawing Figures

METHOD OF OPERATING A COPPER CONVERTER

BACKGROUND OF THE INVENTION

1. Field of the Invention:

This invention relates to a method of operating a copper converter in which crude copper is produced from matte.

2. Description of the Prior Art:

A copper converter is a furnace for producing crude copper from matte by oxidizing the matte and removing iron and sulfur therefrom by the air of oxygen-enriched air blown thereinto through the tuyeres located below the surface of the molten charge. Its operation includes a stage of slag forming and a stage of blister forming. During the stage of slag forming, FeS is oxidized into FeO, and sulfur is oxidized into $SO_2$ and exhausted. If FeO is oxidized, it forms $Fe_3O_4$. As the high melting point and viscosity of $Fe_3O_4$ affects the furnace operation adversely, a flux, such as solid silica, is introduced into the furnace so that $SiO_2$ in the flux may combine with FeO to form an iron-silicate slag. The removal of the iron-silicate slag completes the stage of slag forming. The molten charge is further oxidized to produce crude copper as a result of reactions including those represented by the equations (1) and (2)

$$Cu_2S+O_2=2Cu+SO_2 \quad (1)$$

$$Cu_2S+2CU_2O=6Cu+SO_2 \quad (2)$$

during the stage of blister forming. As all of the reactions taking place during the two stages are exothermic, the molten charge is raised to so high a temperature that the brick lining of the furnace may be damaged. Therefore, it is usual to introduce a cold charge into the furnace to appropriately control the temperature of the molten charge. It is usual to use copper scrap, or smoke particles rising from a copper smelting operation, as a cold charge.

The flux and the cold charge are usually introduced intermittently by a conveyor, or the like in a chute extending through an exhaust gas hood during blowing through the top opening of the converter. Sometimes, however, they are supplied from a container suspended by a crane into the top opening of the converter before the blowing is started.

If the flux and the cold charge are supplied through the top opening of the converter, however, they gather directly below the top opening and partly float on the surface of the molten charge. Therefore, they require a lot of time for melting and reacting, resulting in a lack of uniformity in the temperature of the molten charge. Those portions of the molten charge which have a relatively high temperature damage the brick lining. The molten charge portions having a relatively low temperature have a higher viscosity, which gives rise to increased splashing.

If the flux and the cold charge are, on the other hand, introduced during the blowing, a large amount of air is drawn into the exhaust gas hood for the converter as the chute establishes fluid communication between the exhaust gas hood and the exterior of the converter. The air drawn into the hood lowers the concentration of $SO_2$ in the exhaust gas and thereby adversely affects the operation of a sulfuric acid plant. If, on the contrary, a positive pressure is built up in the hood for some reason for other, the smoke leaking therefrom presents the problem of environmental pollution. In order to avoid these problems as far as possible, it is imperative to introduce large quantities of flux and cold charge within a short time. This, however, results in a shape drop of molten charge temperature and therefore a great increase of splashing.

As a powdery cold charge, such as smoke particles, is scattered by the gas rising through the top opening of the converter, it is usual to agglomerate it into pellets, or the like, It is, however, impossible to avoid a certain loss of the material due to its powdering during its transportation. Although the scattering material is collected for reuse by a dust collector or like device, it is definitely true that the converter has a correspondingly low production yield, and that the particles are not easy to handle and their scattering is very likely to worsen the problem of environmental pollution.

SUMMARY OF THE INVENTION

It is an object of this invention to provide a method of operating a copper converter which enables the uniform melting and reaction of the flux and the cold charge to maintain the molten charge at a uniformly controlled temperature, and which minimizes their scattering losses.

This object is attained by introducing at least a part of a flux and a cold charge both in powdery form into the molten charge through a lance extending through the top of the converter.

DETAILED DESCRIPTION OF THE INVENTION

Figure 1:
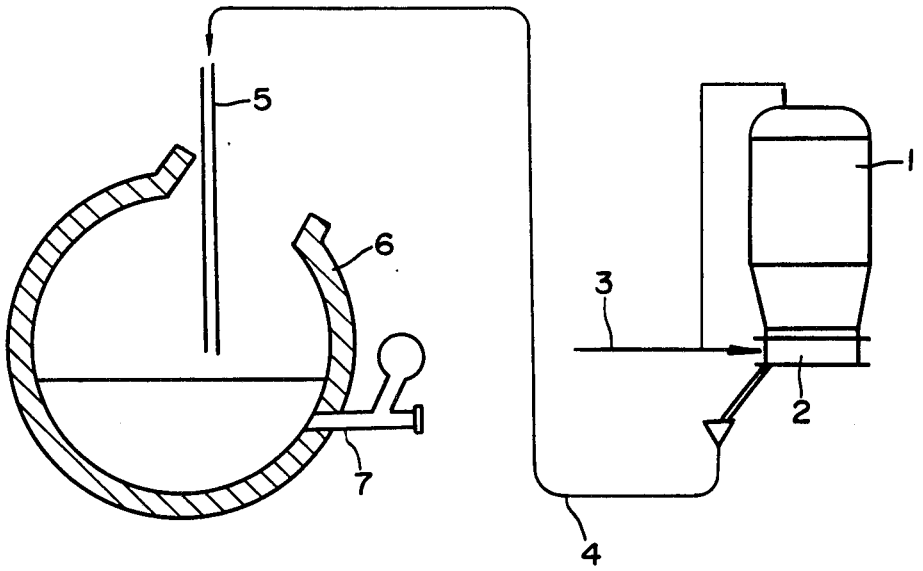
FIG. 1 is a diagrammatic representation of an apparatus which can advantageously be used to carry out the method of this invention.

Referring to FIG. 1, there is shown by way of example an apparatus which can advantageously be used to carry out the method of this invention. It includes a hopper 1 for holding a flux or cold charge in powdery form and a table feeder 2 provided at the bottom of the hopper 1 for delivering the flux or cold charge therefrom. An air supply line 3 for supplying compressed air at a pressure of about 6 $kg/cm^2$ is connected to the hopper 1 and the table feeder 2 to convey the powdery material through delivery line 4 from the table feeder 2 to a lance 5. The lance 5 is vertically movable into a converter 6 down to a position in which its lower end is close to the surface of the molten charge. The converter 6 has a number of tuyeres 7 through which air or oxygen-enriched air is blown into the converter 6.

Figure 2:
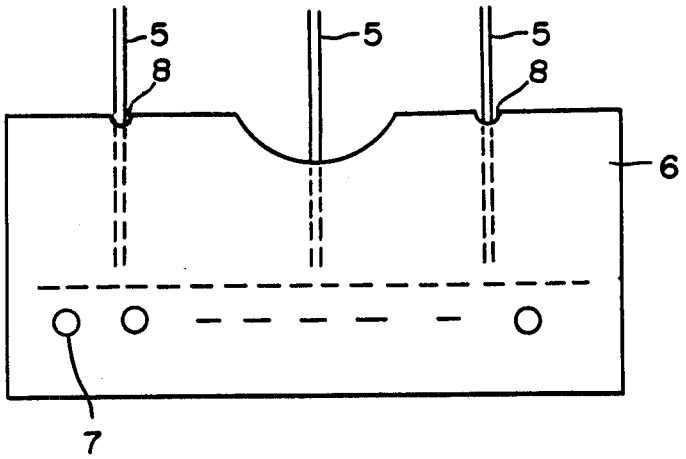
FIG. 2 is a schematic view showing the lances extending into the converter for carrying out the method of this invention.

If the converter is relatively small, it is sufficient to employ only one lance 5. If the converter is large, however, it is advisable to employ a plurality of lances 5 as shown in FIG. 2. One of the lances 5 is inserted through the top opening of the converter 6 and each of the other lances 5 is inserted through a small hole 8 formed on either side of the top opening.

The flux or cold charge is conveyed from the table feeder 2 to the lance 5 through a delivery line 4 and blown into the molten charge by compressed air through the lance 5. While smoke particles can be used as they are, it is advisable to crush silica or the like so that the material which is delivered into the converter may have a particle size not exceeding 5 mm, or preferably, 80% of the material have a particle size not exceeding 200 mesh. The material is delivered from the lance 5 at a rate of at least 20 meters per second. If a slower rate is employed, it is difficult to ensure the proper delivery of the material into the molten charge. The lower end of the lance 5 and the surface of the molten charge preferably has a distance not exceeding 200 mm therebetween as measured when the molten charge has a still surface. Any greater distance should be avoided, since a larger scattering loss of the material is likely to result.

According to the method of this invention, it is possible to ensure the proper delivery of the flux or cold charge into the molten charge without an flotation thereof on its surface. In sofar as they are powdery, they have a by far larger specific surface area than any of the agglomerated material hitherto used, and require a much shorter time for melting or reacting. This ensures the uniform distribution of molten charge temperature throughout the converter and the avoidance of any sharp temperature drops that have hitherto resulted from the rapid introduction of the agglomerated material.

As the material is introduced into the molten charge at a high speed through the lance, it is possible to minimize the scattering loss of the material into the exhaust gas. The hole in the hood through the lance is inserted and the holes provided for insertion of a plurality of lances, which are small enough, are easy to seal against the leakage of air into exhaust gas and the leakage of exhaust gas out of the converter.

This invention is particularly effective if the whole quantities of the flux and the cold charge are powdery and delivered into the molten charge through the lance or lances. The method of this invention, however, does not preclude the direct delivery of, for example, large anode scraps or silica hardly containing any powder through the top opening of the converter, as there is virtually no scattering loss into exhaust gas, in addition to the delivery through the lance or lances of, for example, smoke particles or copper scrap in powdery form. In any case, the delivery of powder material through the lance is effective to control the temperature of furnace operation.

The invention will now be described more specifically with reference to a number of examples thereof.

EXAMPLE 1

A PS converter having an inside diameter of 1.5 m and a length of 1.68 m and provided with three tuyeres was charged with 6.1 tons of copper matte containing 53.8% by weight of copper and 500 kg of silica. Oxygen-enriched air containing 32% by volume of oxygen was blown into the charge at a rate of 1630 $Nm^3/h$ through the tuyeres. The stage of slag forming was continued for 67 minutes. After the slag had been removed, oxygen-enriched air having the same oxygen content as that which had been used during the state of slag forming was blown into the charge at the same rate through the tuyeres. A lance having an inside diameter of 41.6 mm was inserted through the top opening of the converter. Smoke particles generated by a flash smelting furnace and containing 28.6% by weight of copper, 7.8% by weight of sulfur and 7.5% by weight of iron were blown into the molten charge through the lance at a rate of 10 to 40 kg per minute by compressed air supplied at a rate of 120 $Nm^3/h$. A total of 580 kg of smoke particles were blown into the molten charge in 45 minutes. The blowing of oxygen-enriched air was continued until the stage of blister forming lasted for an hour.

For the sake of comparison, the same converter was charged with 6.1 tons of copper matte containing 54.3% by weight of copper and 500 kg of silica, and oxygen-enriched air containing 30% by volume of oxygen was blown into the charge at a rate of 1750 $Nm^3/h$ to complete the stage of slag forming. The same conditions of air blowing were employed to start the stage of blister forming. The pellets formed from smoke particles of the same composition as hereinabove described were delivered into the converter through its top opening in three installments weighing 200 kg, 200 kg and 100 kg, respectively. The stage of blister forming was continued for an hour.

Figure 3:
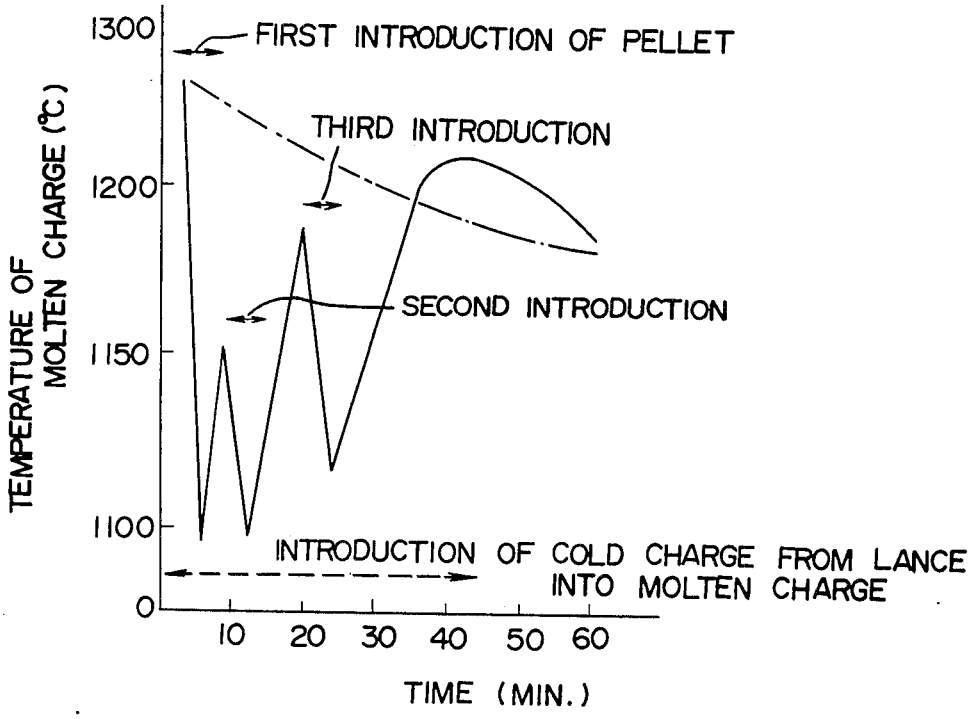
FIG. 3 is a graph comparing the method of this invention with a conventional method with respect to the temperature of the molten charge during the stage of blister forming.

The variation in molten charge temperature during the stage of blister forming was measured by a consumable thermocouple temperature measuring instrument. The results are shown in FIG. 3. The curve drawn by a one-dot chain line shows the results obtained by the method of this invention, and the curve by a solid line shows the results obtained by the conventional method employed for the sake of comparison. The curve showing the results of this invention indicates only a gradually decreasing temperature, while the curve showing the results of the conventional method represents a sharp drop in temperature upon each introduction of the pellets. According to the method of this invention, it was possible to avoid any heavy splashing which had conventionally been unavoidable immediately after the cold charge was introduced into the molten charge.

EXAMPLE 2

The converter used in Example 1 was employed for repeating the operation according to the method of this invention 14 times. For each operation, the converter was charged with six to seven tons of copper matte containing 53 to 56% by weight of copper and 500 to 700 kg of silica, and 800 to 2500 kg of smoke particles from a flash smelting furnace were blown through the lance as a cold charge. An apparatus was located in close proximity to the converter for collecting relatively coarse cold charge particles scattering through its top opening and determing their loss.

For the sake of comparison, the operation according to the conventional method was repeated 14 times by charging the converter with the same quantities of matte of the same composition and silica as hereinabove mentioned, but introducing 800 to 2500 kg of pellets of the smoke particles from the flash smelting furnace through the top opening of the converter. Their scattering losses were likewise measured.

Figure 4:
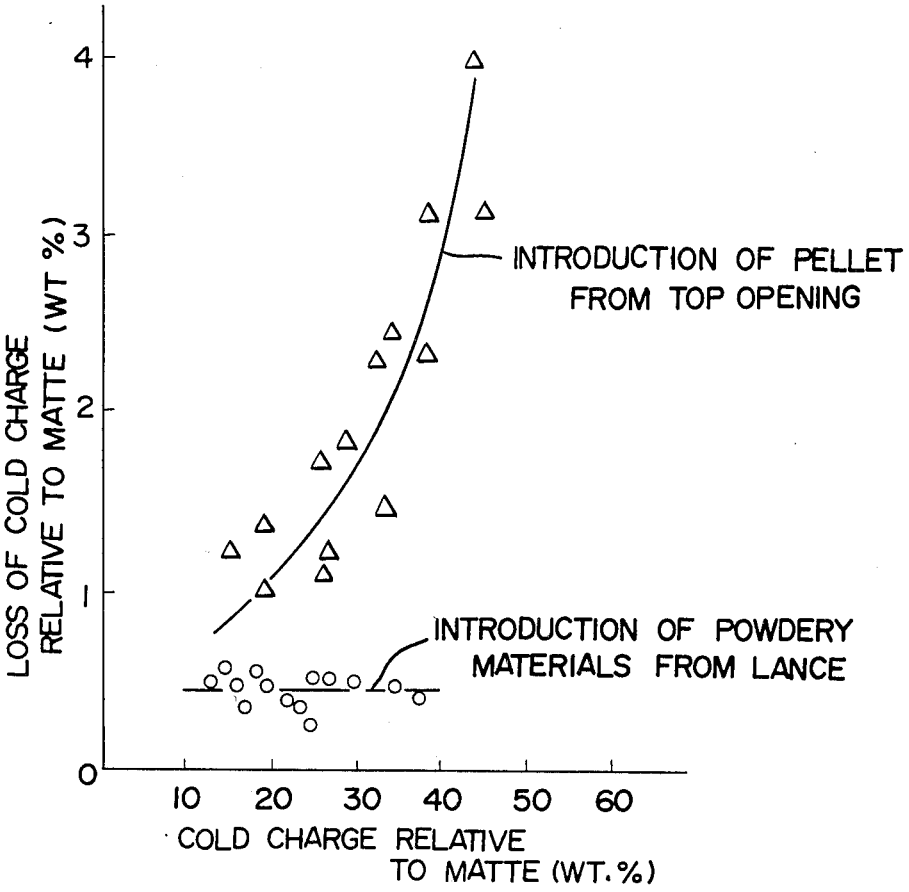
FIG. 4 is a graph comparing the method of this invention with the conventional method with respect to the scattering loss of the cold charge.

The results are shown in FIG. 4. The abscissa in FIG. 4 represents the weight percentage of the cold charge relative to the matte, and the ordinate represents the loss of the cold charge by weight percentage relative to the matte. The circles in FIG. 4 show the results of this invention and the triangles show the results of the conventional method. As is obvious therefrom, the loss of the cold charge particles by the method of this invention was very small, especially with an increase in the proportion of the cold charge relative to the matte, as compared with the loss resulting from the conventional method.

What is claimed is:

1. In a method of producing copper from a matte containing copper, iron and sulfur in a copper converter which includes a lance extending downwardly therein, the method including the steps of heating said matte in the copper converter to make it molten, blowing oxygen into said molten matte to produce $SO_2$ gas, adding a cold flux to said molten matte to form an iron silicate slag, and adding a cold charge of matte to said molten matte, the improvement wherein at least a portion of said cold flux is in the form of a powder, wherein at least a portion of said cold charge of matte is in the form of a powder, and wherein said portions of cold flux and cold charge of matte are blown through said lance onto the surface of said molten matte in said copper converter such that temperature variations in the molten matte due to addition of said cold flux and cold charge of matte is reduced.

2. The method as defined in claim 1, wherein said portions of cold flux and cold charge of matte are supplied through said lance at a speed of at least 20 meters per second.

3. The method as defined in claim 1, including the steps of positioning said lance relative to the surface of said molten matte in said copper converter such that a distance of up to 200 mm is left therebetween.

4. The method as defined in claim 1, wherein said cold charge of matte is composed of copper scrap.

5. The method as defined in claim 1, wherein said cold charge of matte is composed of smoke particles from a copper smelting apparatus.

6. The method as defined in claim 1, wherein said cold flux is solid silica.

7. The method as defined in claim 6, wherein said portion of cold flux of solid silica is composed of particles having a size up to 5 mm.

8. The method as defined in claim 7, wherein 80% of the particles in said portion of cold flux have a size up to 200 mesh.

* * * * *